US006816086B1

(12) United States Patent
Kieffer, Sr.

(10) Patent No.: US 6,816,086 B1
(45) Date of Patent: Nov. 9, 2004

(54) DRIVEWAY SIGNALING DEVICE

(76) Inventor: Jeffrey Kieffer, Sr., 333 Chester St., Atglen, PA (US) 19310

( * ) Notice: Subject to any disclaimer, the term of this patent is extended or adjusted under 35 U.S.C. 154(b) by 82 days.

(21) Appl. No.: 10/205,854

(22) Filed: Jul. 26, 2002

(51) Int. Cl.[7] ..... G08G 1/01

(52) U.S. Cl. ..... 340/933; 340/436; 340/565; 340/566; 340/907; 340/908; 340/908.1

(58) Field of Search ..... 340/933, 435, 340/436, 901, 907, 908, 908.1, 551, 552, 553, 554, 556, 557, 561, 562, 565, 566

(56) References Cited

U.S. PATENT DOCUMENTS 4,713,910 A * 12/1987 Quante ..... 340/908
4,843,337 A * 6/1989 Conn, Jr. et al. ..... 340/908
5,371,489 A * 12/1994 Carroll et al. ..... 340/565
5,448,219 A * 9/1995 Yoshikawa et al. ..... 340/436
5,831,391 A * 11/1998 MacKay ..... 340/565
6,166,660 A * 12/2000 Grenier ..... 340/932.2
6,198,410 B1 * 3/2001 White et al. ..... 340/907
6,392,541 B1 * 5/2002 Bucher et al. ..... 340/541

* cited by examiner

*Primary Examiner*—Davetta W. Goins
(74) *Attorney, Agent, or Firm*—Goldstein Law Offices, P.C.

(57) ABSTRACT

A driveway signaling device for detecting motion in a street immediately in front of a driveway and alerting a driver about to exit the driveway of such movement. The device has a pole, a motion detecting assembly mounted on the pole, and an anchor for anchoring the pole into the ground. The motion detecting assembly is mounted near the pole top, including a pair of motion detectors that extend outward from the sides of the pole in opposite directions for detecting motion in either direction in the street. The assembly has, a "red" light, a "green" light, a power source, and a logic device connecting the motion detectors to the pair of lights and the power source. Upon detection of movement, the "red" light is illuminated, signaling to the driver that it is hot safe to exit from the driveway. When no movement is detected for a predetermined time period, the "green" light is illuminated, signaling to the driver that it is safe to proceed out of the driveway.

20 Claims, 4 Drawing Sheets

DRIVEWAY SIGNALING DEVICE

BACKGROUND OF THE INVENTION

The invention relates to a driveway signaling device. In particular, the invention is a signaling device that is positioned at the end of a driveway, adjacent to the street. The device alerts a vehicle about to exit the driveway of the presence of any object, person, or animal approaching or crossing in front of the driveway.

Drivers of motor vehicles often experience a greater degree of difficulty seeing objects in their path of travel when driving in reverse. This is due largely in part to the different steering movements involved with moving backwards, as well as the decreased visibility afforded the driver by structure of the vehicle. Thus, rearwardly exiting from a driveway can be a stressful ordeal, especially if the driveway is on a street with substantial traffic flow. It is difficult for the driver to concentrate on backing the vehicle out of the driveway, while having to also watch for oncoming traffic, pedestrians, people on bicycles, and animals crossing in front of the driveway.

Thus, there exists a need for a driveway signaling device that alerts a driver of movement on either side of the driveway. Such a device would be equipped with motion detectors that are in communication with a set of lights positioned on the device. According to the light that is illuminated, the driver can tell whether or not it is safe to proceed out of the driveway.

U.S. Pat. No. 4,864,298 to Dombrowski discloses a driver alerting device that is specifically configured for alerting the driver of a motor vehicle to the presence of any objects in close proximity behind the vehicle. However, the device is mounted at the rear end of a vehicle and is in communication with the back-up lights and air brakes of the vehicle.

U.S. Pat. No. 4,843,337 to Conn, Jr. et al. discloses a driveway safety light that signals to anyone passing in front of the driveway that a motor vehicle is about to exit therefrom. However, the safety light is not configured to alert a driver about to exit the driveway that someone is crossing the path of the driveway.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved driveway signaling device. As such, the general purpose of the present invention, which will be described subsequently in greater detail, is to provide a new and improved driveway signaling device which has all the advantages of the prior art and none of the disadvantages.

To attain this, the present invention essentially comprises a driveway signaling device for detecting motion in a street immediately in front of a driveway and alerting a driver about to exit the driveway of such movement. The device has a pole, a motion detecting assembly mounted on the pole, and an anchor for anchoring the pole into the ground. The motion detecting assembly is mounted near the pole top, including a pair of motion detectors that extend outward from the sides of the pole in opposite directions for detecting motion in either direction in the street. The assembly has, a "red" light, a "green" light, a power source, and a logic device connecting the motion detectors to the pair of lights and the power source. Upon detection of movement, the "red" light is illuminated, signaling to the driver that it is not safe to exit from the driveway. When no movement is detected for a predetermined time period, the "green" light is illuminated, signaling to the driver that it is safe to proceed out of the driveway.

It is an object of the invention to produce a driveway signaling device that alerts a driver to the presence of an object, person, or animal moving behind the vehicle. Accordingly, the signaling device is semi-permanently mounted in the ground at the driveway opening to signal the driver when approaching the signaling device whether it is safe to proceed into the street.

It is a further object of the invention to provide a driveway signaling device which securely mounts in place and resists theft. Accordingly, an anchor mounts within the ground, and the pole is attached to the anchor such that it may be only detached by unlocking an access door.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
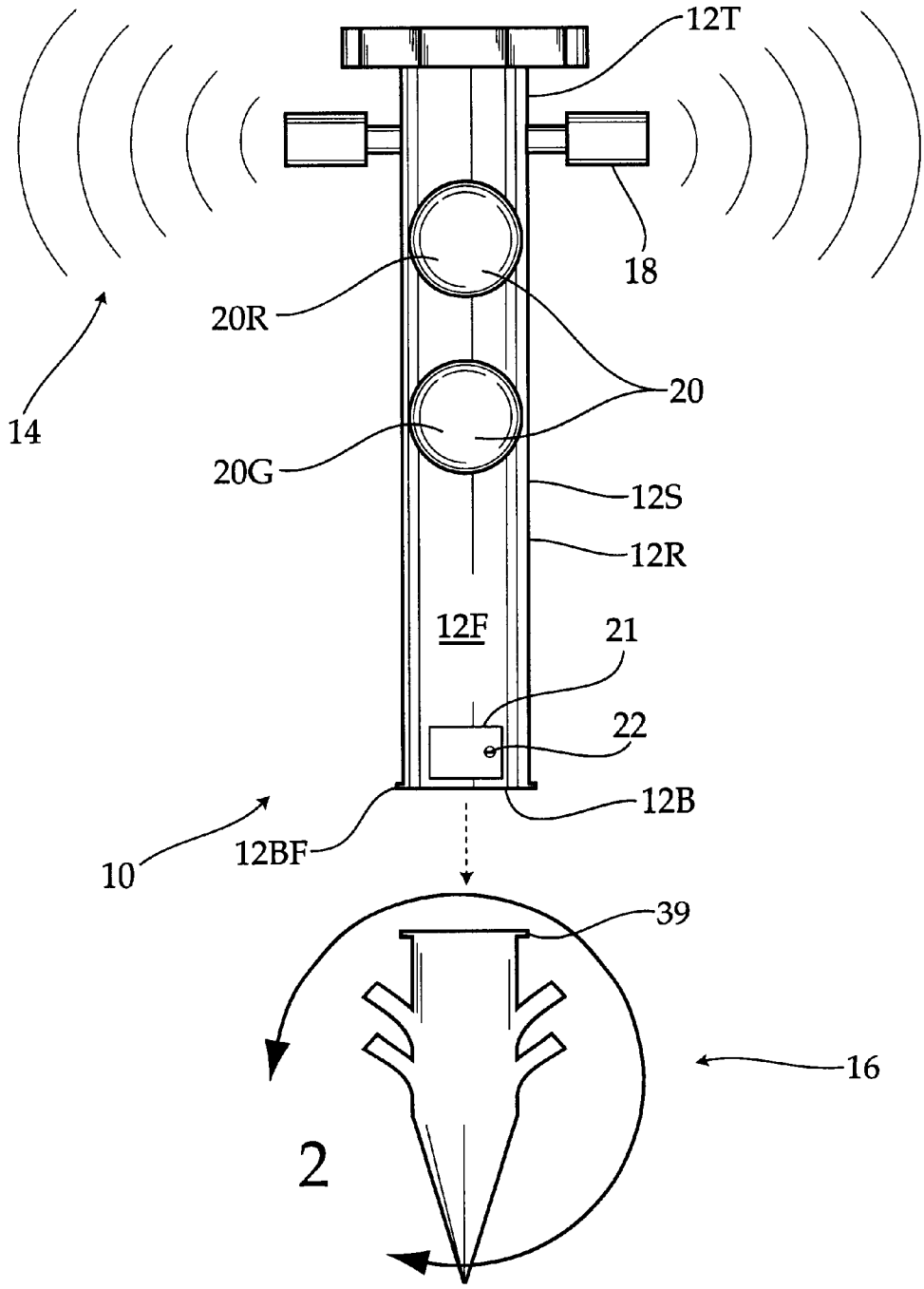
FIG. 1 is an exploded front elevational view of the driveway signaling device showing the pole detached from the anchor.

10 driveway signaling device
12 pole
12T pole top end
12B pole bottom end
12F pole front surface
12R pole rear surface
12S pole side surface
12BF pole bottom flange
14 motion detecting assembly
16 anchor
16T anchor top portion
16B anchor bottom portion
18 motion detector
20 light
20R red light
20G green light
21 access door
22 lock
25 logic unit
26 infrared eye
28 solar panel
30 battery
32 battery compartment

34 spike
36 fin
37 anchoring hole
38 anchor top surface
39 anchor flange
45 anchoring bolt
46 driveway
46S driveway sides
46F driveway front
46R driveway rear
48 driveway surface
50 curtain
52 street
54 vehicle
56 ground surface

DETAILED DESCRIPTION OF THE PREFERRED EMBODIMENTS

FIG. 1 illustrates a driveway signaling device 10 for detecting motion in a street 52 in the vicinity of a driveway 46 and alerting a driver in a motor vehicle 54 about to exit said driveway 46 of said motion. The driveway 46 extends transversely to and toward the street 52, said driveway 46 having has a pair of sides 46S, a drivable surface 48 extending between the sides, the driveway 48 having a driveway front 46F and a driveway rear 46R. The driveway 46 further comprises a curtain 50 at the front 46F and adjacent to the street 52, and a ground surface 56 adjacent to the curtain 50.

The device 10 essentially comprises a pole 12, a motion detecting assembly 14 mounted on the pole 12, and an anchor 16 for anchoring the pole 12 into the ground. The pole 12 has a top end 12T, a bottom end 12B having a bottom flange 12BF, a front surface 12F, a rear surface 12R, a pair of side surfaces 12S, and a hollow interior. Note that the pole is shown as being cylindrical, however for the purposes of the invention, other shapes may be equally suitable, such a pole of square cross section. In particular, the conventions "front", "rear", as well as the "sides", as used herein, provide context for the relative location of the various elements attached thereto.

Figure 3:
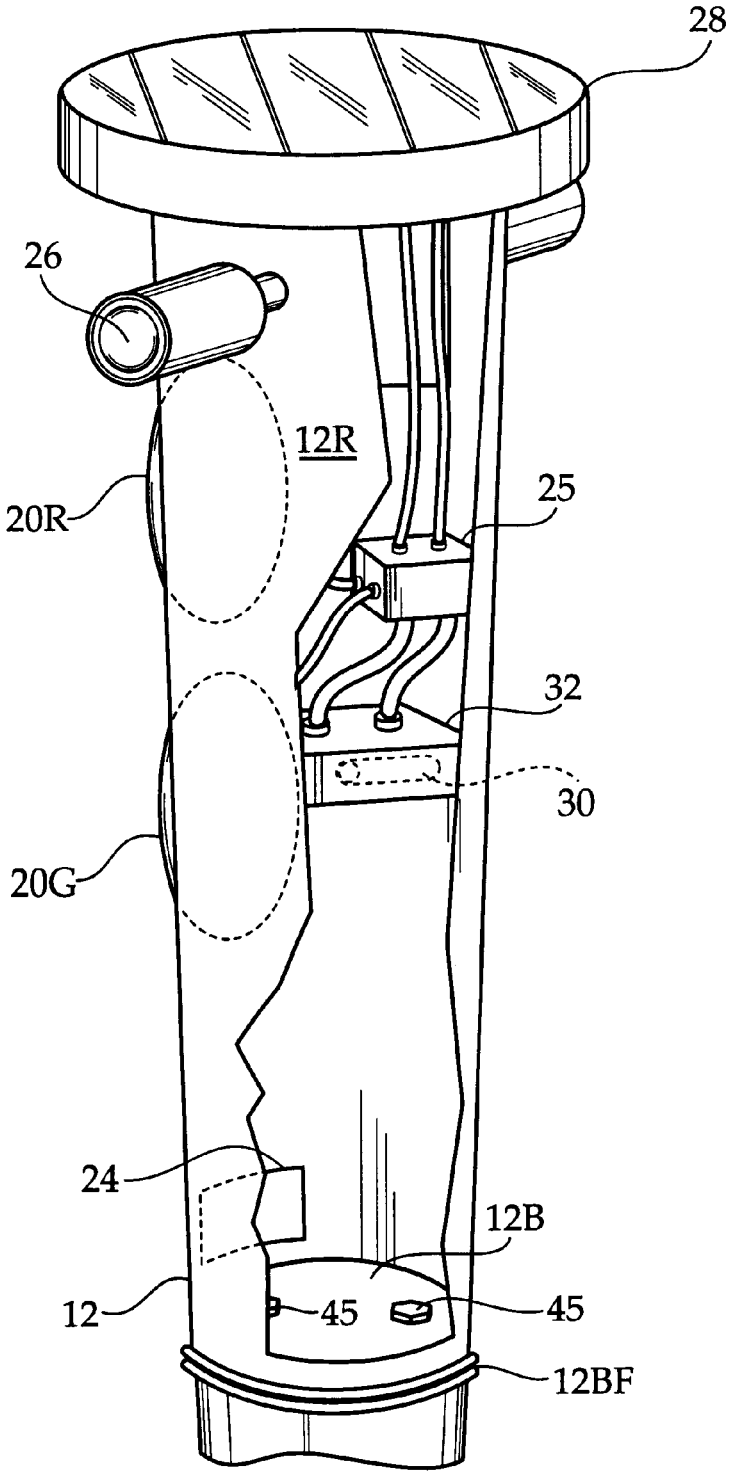
FIG. 3 is a rear perspective view of the pole, with a portion of the rear surface removed to reveal internal details thereof.
Figure 4:
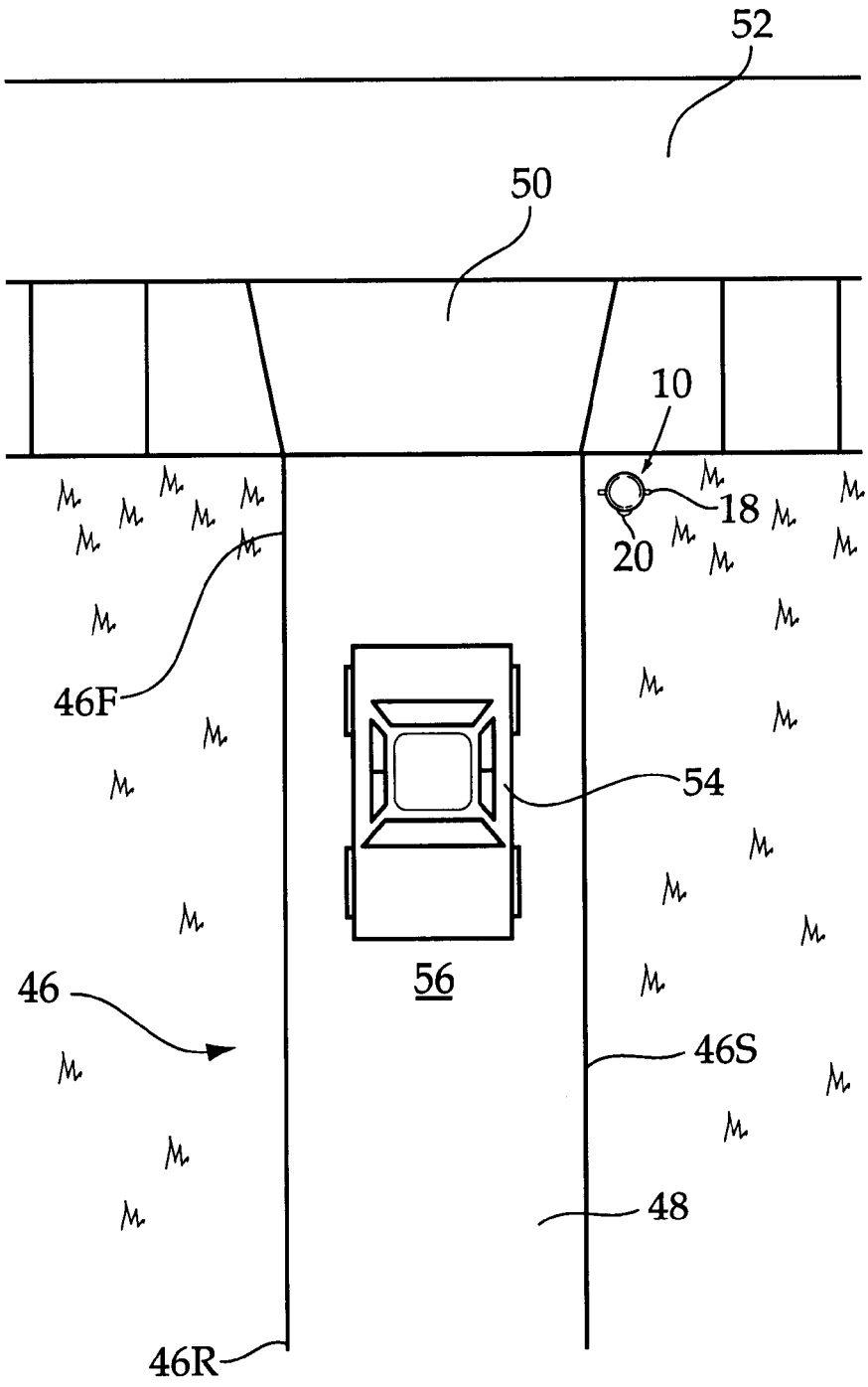
FIG. 4 is a top plan view, illustrating the invention in use, mounted near the exit of a driveway.

The motion detecting assembly 14 is mounted near the top end 12T of the pole 12. The motion detecting assembly 14 comprises a pair of motion detectors 18 extending from opposite sides 12S of the pole 12, a pair of lights 20 mounted on the pole front surface 12F including a "red" light 20R and a "green" light 20G, a power source preferably provided in the form of a battery compartment 32 containing batteries 30, and a logic unit 25 connecting the motion detectors 18, the pair of lights 20, and the power source 30 as illustrated in FIG. 3. The motion detectors 18 detect any movement in the near vicinity of the pole 12 and produce a signal to the logic unit 25 in response thereto. Upon detection of movement, the logic unit 25 causes the "red" light 20R to illuminate, signaling to the driver that it is not safe to exit from the driveway. Once the object detected has moved past the signaling device 10 and out of the range of the motion detectors 18, after a predetermined time period has elapsed, the logic unit, 25 turns off the "red" light 20R, and illuminates the "green" light 20G, signaling to the driver that it is safe to proceed out of the driveway. Accordingly, as would be appreciated by those of ordinary skill in the art, the logic unit 25 would contain a timer having a suitably calibrated predetermined period and relays as appropriate to carry out the above functionality.

In addition, infrared eyes 26 can be provided with the motion detecting assembly 14 to detect non-moving objects such as animals and humans which may be motionless, yet still present an obstacle to the driver. The infrared eyes 26 would similarly be in communication with the logic unit 25, which can be calibrated appropriately to detect obstacles while avoiding false triggering.

The motion detecting assembly 14 is generally powered by the batteries 30. The power source may also include a solar panel 28 which selectively powers the motion detecting assembly. The solar panel 28 is positioned at the top end 12T of the pole 12 and is oriented upward in order to receive the greatest amount of sunlight during the middle of the day, excess power generated by the solar panel 28 is used to recharge the batteries 30. During the night hours, the motion detector assembly 14 may be powered strictly by the batteries 30. Such power switching to selectively power the motion detector assembly 14 by either the solar panel 28 or batteries 30 and to selectively charge the batteries 30 with the solar panel 28, when possible, would also be under the control of the logic unit in a conventional fashion.

Further, to save power, the unit can be configured so that the green light 20G is selectively turned off when it is not needed to notify a driver of the status of traffic in the street. In this regard, an addition motion detector (not shown) in communication with the logic unit 25 might be positioned on the pole front 12F and thereby oriented toward the driveway rear 46R to detect a vehicle approaching the driveway front 46F, so that as a motor vehicle 54 approaches the driveway front 46F from the driveway rear 46R, the unit becomes active whereby the logic unit activates the green light 20G. After a period in which no motion is detected within the driveway, the green light 20G is turned off to conserve power.

Figure 2:
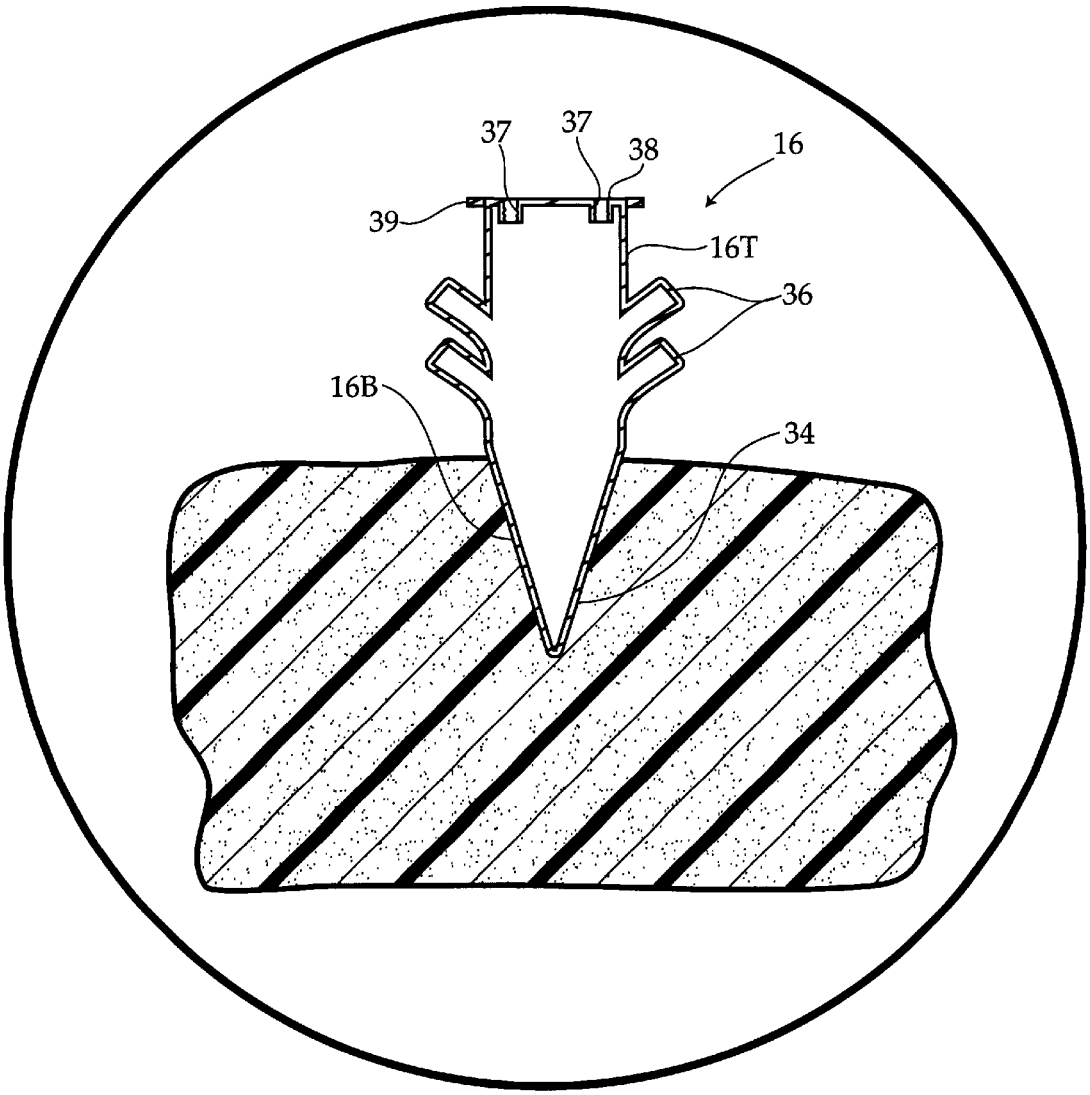
FIG. 2 is a cross sectional view of the anchor taken generally in the area of circle 2 in FIG. 1.

The anchor 16 has a top portion 16T, a bottom portion 16B, a spike 34 positioned at the bottom portion 16B, a plurality of fins 36 extending upward and outward from the anchor 16, and an anchor flange 39 positioned at the top portion 16T which includes an anchor top surface 38. The anchor top surface 38 has a pair of anchoring holes 37 extending downwardly into the anchor flange 39 which are internally threaded. The spike 34 is utilized to penetrate a ground surface near the exit of the driveway and immediately adjacent thereto. The spike facilitates driving the anchor 16 into the ground, as illustrated in FIG. 2. Once anchored in the ground, the fins 36 lodge in place prevent the anchor 16 from being dislodged therefrom. The bottom end 12B of the pole 12 is selectively mated with the anchor 16, thereby positioning the pole 12 upright. In particular, the pole bottom flange 12BF is positioned atop the anchor flange 39. Anchoring bolts 45 are extended through the pole bottom surface 12B and into the anchoring holes 37 for fastening the pole bottom flange 12BF tightly against the anchor flange 39, as seen in FIG. 3. Further, an access door 21 is provided to allow the anchoring bolts 45 to be selectively fastened or removed to selectively attach and detach the pole 12 from the anchor 16. However, a lock 22 is provided on the access door to prevent unauthorized removal of the pole 12 and thus avoid theft thereof.

In use, the driveway signaling device 10 is positioned at the end of a driveway 46, in the ground surface 56 adjacent to the curtain 50 near the street 52. The front surface 12F of the pole 12 is oriented towards the driveway rear 46R, and away from the street 52. This positioning allows the driver of a motor vehicle in the driveway to be able to view the color of the lights 20 illuminated in order to ascertain whether it is safe to exit from the driveway. The pole side surfaces 12S are oriented perpendicular to the driveway 46, and parallel to the street 46. This positioning enables the motion detectors 18 mounted thereon to be able to detect any movement approaching the driveway from either direction in the street.

In conclusion, herein is presented a driveway signaling device for alerting a driver of a motor vehicle attempting to exit a driveway when it is safe to proceed into the street from said driveway. The invention is illustrated by example in the drawing figures, and throughout the written description. It should be understood that numerous variations are possible, while adhering to the inventive concept. Such variations are contemplated as being a part of the present invention.

What is claimed is:

1. A driveway signaling device for detecting movement in a street adjacent to a driveway and alerting a driver of a motor vehicle about to exit said driveway of potential hazards, comprising:

a pole, the pole having a top end, a bottom end having a bottom surface, a front surface, a rear surface, a pair of side surfaces, and a hollow interior;

a motion detecting assembly, said assembly having a pair of motion detectors extending outward in opposite directions from the pole side surfaces of the pole, a red light and a green light mounted on the pole, a power source, and a logic unit, said logic unit connecting the motion detectors, the lights, and the power source, wherein upon detection of movement by the motion detectors, the red light is illuminated by the logic unit to signal the driver that it is not safe to exit from the driveway, after a predetermined period following detection of no additional movement, the logic unit turns off the red light and illuminates the green light to signal the driver that it is safe exit the driveway into the street.

2. The driveway signaling device as recited in claim 1, wherein at least one of the motion detectors has an infrared eye for detecting animals and humans which might present a hazard but are motionless.

3. The driveway signaling device as recited in claim 3, wherein the lights are positioned on the front surface of the pole, such that when the pole is mounted such that the front surface is oriented away from the street the lights are visible to the driver when in the driveway.

4. The driveway signaling device as recited in claim 3, further comprising an anchor for securing the pole in place within the ground, the anchor having a top portion, a bottom portion, a spike positioned at the bottom portion for enabling the assembly to be driven into the ground, such that the pole is selectively mated with the anchor by fastening the pole bottom surface to the anchor top surface.

5. The driveway signaling device as recited in claim 4, wherein the anchor top surface further has an anchor flange, for selectively mating with the pole bottom surface with the anchor top surface by positioning the pole bottom flange against the anchor flange.

6. The driveway signaling device as recited in claim 5, wherein the anchor top surface has anchoring holes extending downwardly therein, further comprising anchoring bolts, and wherein the anchoring bolts are selectively extended through the pole bottom surface into the anchoring holes to secure the pole bottom flange to the anchor flange and thus secure the pole to the anchor.

7. The driveway signaling device as recited in claim 6, wherein the anchor has a plurality of fins which extend upwardly and outwardly therefrom to prevent the anchor from being dislodged from the ground.

8. The driveway signaling device as recited in claim 4, wherein the power source comprises a battery and a solar panel mounted on the pole top end, the battery and solar panel each capable of powering the motion detector assembly, the solar panel capable of recharging the batteries.

9. The driveway signaling device as recited in claim 5, wherein the power source comprises batteries and a solar panel positioned at the top end of the pole, said panel oriented upward towards the sun, the solar panel capable of recharging the batteries.

10. The driveway signaling device as recited in claim 9, wherein the pole further has an access door near the pole bottom surface which selectively provides and prevents access to the anchoring bolts for selectively preventing the anchoring bolts from being removed from the anchoring holes and thus preventing the pole from being removed from the anchor, and wherein a lock is provided on the access door to selectively prevent use of the access door to prevent unauthorized removal of the pole and thereby prevent theft thereof.

11. A safety system for use by a driver of a motor vehicle comprising:

a street;

a driveway extending transverse to and toward the street, having a pair of sides, a drivable surface between said sides having a front and a rear, a curtain at the front of the driveway and adjacent to the street, and a ground surface adjacent to the curtain;

a pole, the pole having a top end, a bottom end having a bottom surface, a front surface, a rear surface, a pair of side surfaces, and a hollow interior, the pole mounted adjacent the curtain in the ground surface, with the front surface oriented toward the driveway rear;

a motion detecting assembly, said assembly having a pair of motion detectors extending outward in opposite directions from the pole side surfaces of the pole and substantially parallel to the street, a red light and a green light mounted on the pole front surface and accordingly oriented toward the driveway rear, a power source, and a logic unit, said logic unit connecting the motion detectors, the lights, and the power source, wherein upon detection of movement by the motion detectors, the red light is illuminated by the logic unit to signal a driver situated near the driveway front that it is not safe to exit from the driveway, after a predetermined period following detection of no additional movement, the logic unit turns off the red light and illuminates the green light to signal the driver that it is safe to exit the driveway into the street.

12. The safety system as recited in claim 11, wherein at least one of the motion detectors has an infrared eye for detecting animals and humans which might present a hazard but are motionless.

13. The safety system as recited in claim 12, wherein the lights are positioned on the front surface of the pole, such that when the pole is mounted such that the front surface is oriented away from the street the lights are visible to the driver when in the driveway.

14. The safety system as recited in claim 13, further comprising an anchor for securing the pole in place within the ground, the anchor having a top portion, a bottom portion, a spike positioned at the bottom portion for enabling the assembly to be driven into the ground, such that the pole is selectively mated with the anchor by fastening the pole bottom surface to the anchor top surface.

15. The safety system as recited in claim 14, wherein the anchor top surface further has an anchor flange, for selectively mating with the pole bottom surface with the anchor top surface by positioning the pole bottom flange against the anchor flange.

16. The safety system as recited in claim 15, wherein the anchor top surface has anchoring holes extending downwardly therein, further comprising anchoring bolts, and wherein the anchoring bolts are selectively extended through the pole bottom surface into the anchoring holes to secure the pole bottom flange to the anchor flange and thus secure the pole to the anchor.

17. The safety system as recited in claim 16, wherein the anchor has a plurality of fins which extend upwardly and outwardly therefrom to prevent the anchor from being dislodged from the ground.

18. The safety system as recited in claim 17, wherein the power source comprises a battery and a solar panel mounted on the pole top end, the battery and solar panel each capable of powering the motion detector assembly, the solar panel capable of recharging the batteries.

19. The safety system as recited in claim 18, wherein the power source comprises batteries and a solar panel positioned at the top end of the pole, said panel oriented upward towards the sun, the solar panel capable of recharging the batteries.

20. The safety system as recited in claim 19, wherein the pole further has an access door near the pole bottom surface which selectively provides and prevents access to the anchoring bolts for selectively preventing the anchoring bolts from being removed from the anchoring holes and thus preventing the pole from being removed from the anchor, and wherein a lock is provided on the access door to selectively prevent use of the access door to prevent unauthorized removal of the pole and thereby prevent theft thereof.

* * * * *